US008162078B2

(12) United States Patent
Anderson

(10) Patent No.: US 8,162,078 B2
(45) Date of Patent: Apr. 24, 2012

(54) VIBRATING DOWNHOLE TOOL

(75) Inventor: Charles Abernethy Anderson, Millarville (CA)

(73) Assignee: CT Energy Ltd. (CA)

( * ) Notice: Subject to any disclaimer, the term of this patent is extended or adjusted under 35 U.S.C. 154(b) by 383 days.

(21) Appl. No.: 12/458,005

(22) Filed: Jun. 29, 2009

(65) Prior Publication Data

US 2010/0326733 A1 Dec. 30, 2010

(51) Int. Cl.
*E21B 7/24* (2006.01)
*E21B 28/00* (2006.01)

(52) U.S. Cl. ..... 175/56; 166/177.2; 166/177.6; 166/177.7

(58) Field of Classification Search ..... 175/55, 175/56; 166/177.6, 177.7, 177.1, 177.2
See application file for complete search history.

(56) References Cited

U.S. PATENT DOCUMENTS 3,764,968 A 10/1973 Anderson
4,058,163 A * 11/1977 Yandell ..... 166/177.6
4,351,037 A * 9/1982 Scherbatskoy ..... 367/85
4,686,658 A * 8/1987 Davison ..... 367/85
4,734,892 A 3/1988 Kotlyar
4,890,682 A 1/1990 Worrall et al.
4,953,595 A 9/1990 Kotlyar
5,357,483 A 10/1994 Innes
5,787,052 A 7/1998 Gardner et al.
6,279,670 B1 8/2001 Eddison et al.
6,289,998 B1 9/2001 Krueger et al.
6,431,294 B1 8/2002 Eddison et al.
6,439,318 B1 8/2002 Eddison et al.
6,508,317 B2 1/2003 Eddison et al.
6,571,870 B2 6/2003 Zheng et al.
6,714,138 B1 3/2004 Turner et al.
7,011,156 B2 3/2006 von Gynz-Rekowski
7,077,205 B2 7/2006 Eddison
7,139,219 B2 * 11/2006 Kolle et al. ..... 367/85
7,219,726 B2 5/2007 Zheng et al.
7,327,634 B2 2/2008 Perry et al.
7,417,920 B2 8/2008 Hahn et al.

* cited by examiner

*Primary Examiner* — Giovanna Wright
(74) *Attorney, Agent, or Firm* — Scott T. Griggs; Griggs Bergen LLP

(57) ABSTRACT

Disclosed is an apparatus for vibrating a downhole drill string operable to have a drilling fluid pumped therethrough. The apparatus comprises a tubular body securable to the drill string and having a central bore therethrough, a valve in the tubular body for venting the drilling fluid out of the drill string and a valve actuator for cyclically opening and closing the valve. The method comprises pumping a drilling fluid down the drill string and cyclically venting the drilling fluid through the valve so as to cyclically reduce the pressure of the drilling fluid in the drill string. The valve may comprise a tubular body port and a corresponding rotor port selectably alignable with the tubular body port as the rotor rotates within the central bore. The valve actuator may comprise at least one vane on the rotor for rotating the rotor as the drilling fluid flows therepast.

17 Claims, 7 Drawing Sheets

VIBRATING DOWNHOLE TOOL

BACKGROUND OF THE DISCLOSURE

1. Field of Disclosure

The present disclosure relates to vibrating tools in general, and in particular to a method and apparatus for vibrating a downhole tool in a drill string.

2. Description of Related Art

In the field of drilling, friction may frequently impair the ability of the drill string to be advanced within the hole. For example, highly deviated holes or horizontal drilling cannot rely on the weight of the drill pipe alone to overcome friction from the horizontal pipe resting against the wall of the hole.

Conventional vibration tools have alternatingly increased the pressure of the drilling fluid within the drill string by cyclically blocking and unblocking the flow of the drilling fluid within the drill string. Such devices accordingly cyclically increase the pressure of the drilling fluid within the drill string and then release it. Such devices disadvantageously require a high supply pressure over and above the supply pressure for the drilling fluid. This increases cost and complexity of the machinery required to support this operation. In addition, many conventional vibration tools involve complex downhole systems and devices which may be more prone to breakage.

Many such conventional vibration tools also create backpressure in the drilling fluid supply. This has the negative consequences of requiring supply pumps of greater capacity and also reduces the supply pressure to the drilling bit. Still other apparatuses have utilized blunt mechanical impacts which increases the wear life and the complexity of the design.

SUMMARY OF THE DISCLOSURE

According to a first embodiment there is disclosed a method of vibrating a downhole drill string. The method comprises pumping a drilling fluid down the drill string and cyclically venting the drilling fluid through a valve in a side wall of the drilling string so as to cyclically reduce the pressure of the drilling fluid in the drill string.

The method may further comprise rotating a rotor within a tubular body located in-line within the drill string wherein the venting comprises intermittently passing the drilling fluid through a rotor port in the rotor and a corresponding tubular body port in the tubular body. The rotor may be rotated by the drilling fluid.

The method may further comprise separating the drilling fluid into a central bypass portion and an annular rotor portion, passing the bypass portion past the rotor and rotating the rotor with the rotor portion. The bypass portion and the rotor portion may be combined after the rotor portion rotates the rotor wherein the rotor port and the tubular port pass the combined rotor portion and the bypass portion therethrough.

According to a further embodiment there is disclosed an apparatus for vibrating a downhole drill string. The drill string is operable to have a drilling fluid pumped therethrough. The apparatus comprises a tubular body securable to the drill string and having a central bore therethrough, a valve in the tubular body for venting the drilling fluid out of the drill string and a valve actuator for cyclically opening and closing the valve.

The valve may comprise a radial tubular body port in the tubular body and a rotor located within the central bore having a radial rotor port wherein the rotor port is selectably alignable with the tubular body port as the rotor rotates within the central bore. The valve actuator may comprise at least one vane on the rotor for rotating the rotor as the drilling fluid flows therepast. The rotor may include a central bypass bore therethrough and a plurality of vanes radially arranged around the central bypass bore.

The apparatus may further comprise a separator for separating the drilling fluid into a bypass portion and a rotor portion secured within the central bore, the rotor portion being directed onto the plurality of vanes so as to rotate the rotor, the bypass portion being directed though the bypass bore of the rotor. The separator may include a central bypass port and an annular rotor passage therearound. The separator may be located adjacent to the rotor such that the central bypass port of the separator directs the bypass portion of the drilling fluid though the bypass bore of the rotor and wherein the rotor passage of the separator directs the rotor portion of the drilling fluid onto the plurality of vanes of the rotor. The rotor passage of the separator may include stator vanes for directing the rotor portion of the drilling fluid onto the plurality of vanes.

The apparatus may further comprise a plurality of rotor ports selectably alignable with a plurality of tubular body ports. Each of the plurality of rotor ports may be selectably alignable with a unique tubular body port.

The tubular body may be connectable inline within a drill string. The tubular body may include threaded end connectors for linear connection within a drill string.

The bypass port of the separator may include an inlet shaped to receive a blocking body so as to selectably direct more drilling fluid through the rotor passage. The inlet may have a substantially spherical shape so as to receive a spherical blocking body.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
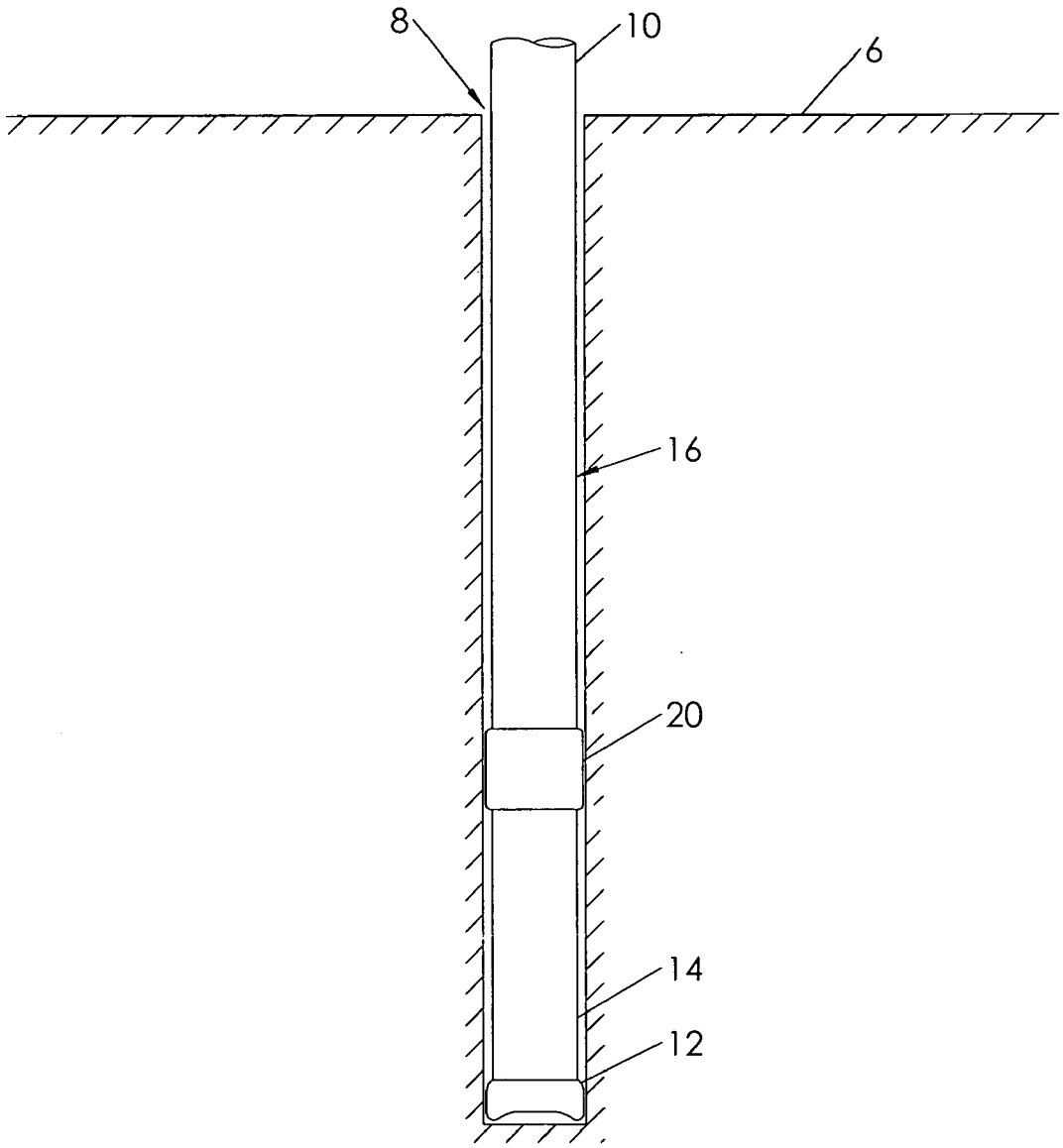
FIG. 1 is a perspective view of the vibrating downhole tool located within a drill string.

Referring to FIG. 1, a drill string 10 is illustrated down a bore hole 8 in a soil or rock formation 6. The drill string includes a drill bit 12 at a lower end 14 thereof and an apparatus according to a first embodiment shown generally at 20 for vibrating the drill string within the bore hole 8. The apparatus 20 may be located proximate to the lower end 14 of the drill string 10 or at an intermediate portion 16 of the drill string 10. It will also be appreciated that a plurality of apparatuses 20 may be located at a plurality of locations along the drill string.

Figure 2:
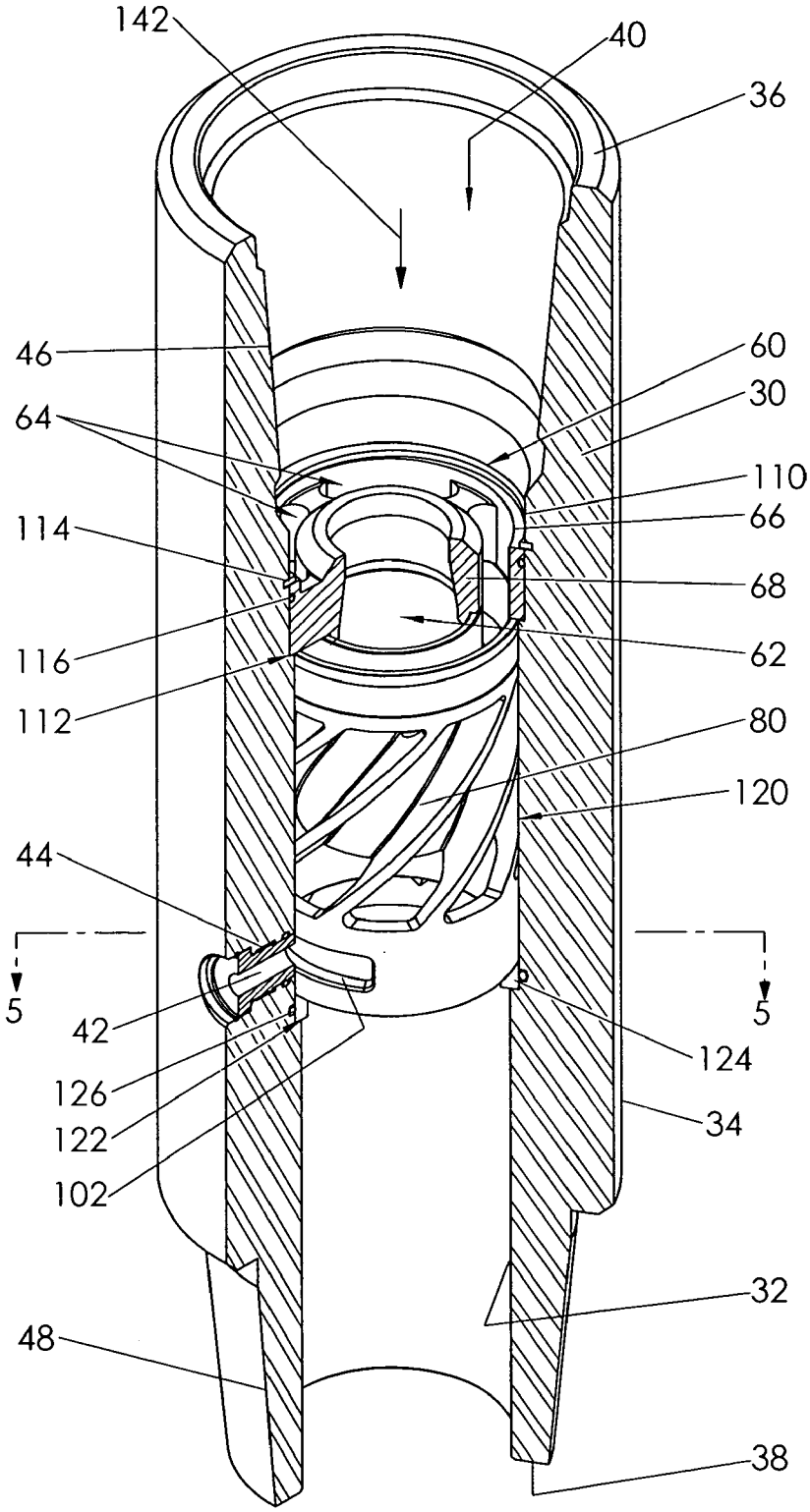
FIG. 2 is a partial cross-sectional perspective view of a vibrating downhole tool according to a first embodiment.

Turning now to FIG. 2, the apparatus 20 comprises a tubular body 30, a flow separator 60 and a rotor 80. The tubular body 30 has a cylindrical wall 31 having inner and outer surfaces 32 and 34, respectively extending between inlet and outlet ends, 36 and 38, respectively. The inner surface 32 defines a central bore 40. The tubular body 30 includes at least one radial tubular body port 42 extending therethrough. The tubular body port 42 may be formed as a bore through the wall 31 or may optionally be located within a tubular body port insert 44 as illustrated in FIG. 2. The use of a tubular body port insert 44 facilitates the interchangability of tubular body port 42 of differing sizes as will be further described below.

As illustrated the tubular body port insert 44 may be threadably secured within the wall 31 or by any other suitable means, such as by way of non-limiting example, compression fit, latches, retaining clips or the like. As illustrated, the tubular body port 42 may have a throttling cross section such that the tubular body port 42 is wider proximate to the interior surface 32 of the tubular body than proximate to the exterior surface 34. The use of a throttling cross section will assist in controlling the volume of drilling fluid vented therethrough. The tubular body port insert 44 may be sealed to the tubular body 30 with an o-ring to prevent washout and backed with a snap ring to prevent the tubular body port insert 44 from backing out.

The inlet and outlet ends 36 and 38 of the tubular body 30 may include interior and exterior threading 46 and 48, respectively, for securing the tubular body in-line with the drill string 10. It will be appreciated that the interior and exterior threading 46 and 48 will be of a conventional type, such as a pin/box type to facilitate ready connection with the drill string 10. The tubular body 30 is of steel construction and is surface hardened for durability and abrasion resistance.

Figure 3:
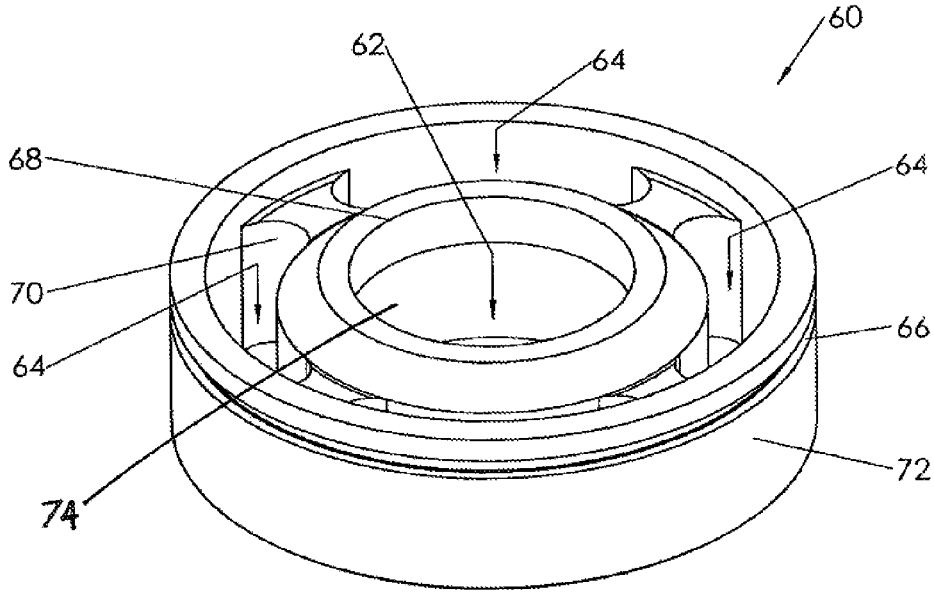
FIG. 3 is a perspective view of a separator of the apparatus of FIG. 2.

The flow separator 60 comprises a disk shaped body having a central bypass passage 62 and a plurality of rotor passages 64 distributed radially around the bypass passage. The flow separator 60 is sized to be located within the central bore 40 of the tubular body as illustrated in FIG. 2. Turning now to FIG. 3, the flow separator 60 comprises an outer cylinder 66 and an inner cylinder 68 with a plurality of radial support arms 70 extending therebetween. The outer cylinder 66 includes an outer surface 72 sized to be securely received within the central bore 40 of the tubular body 30. The inner cylinder includes an inner surface 74 defining the bypass passage. The inner cylinder 68, outer cylinder 66 and the support arms 70 define the rotor passages 64.

Figure 4:
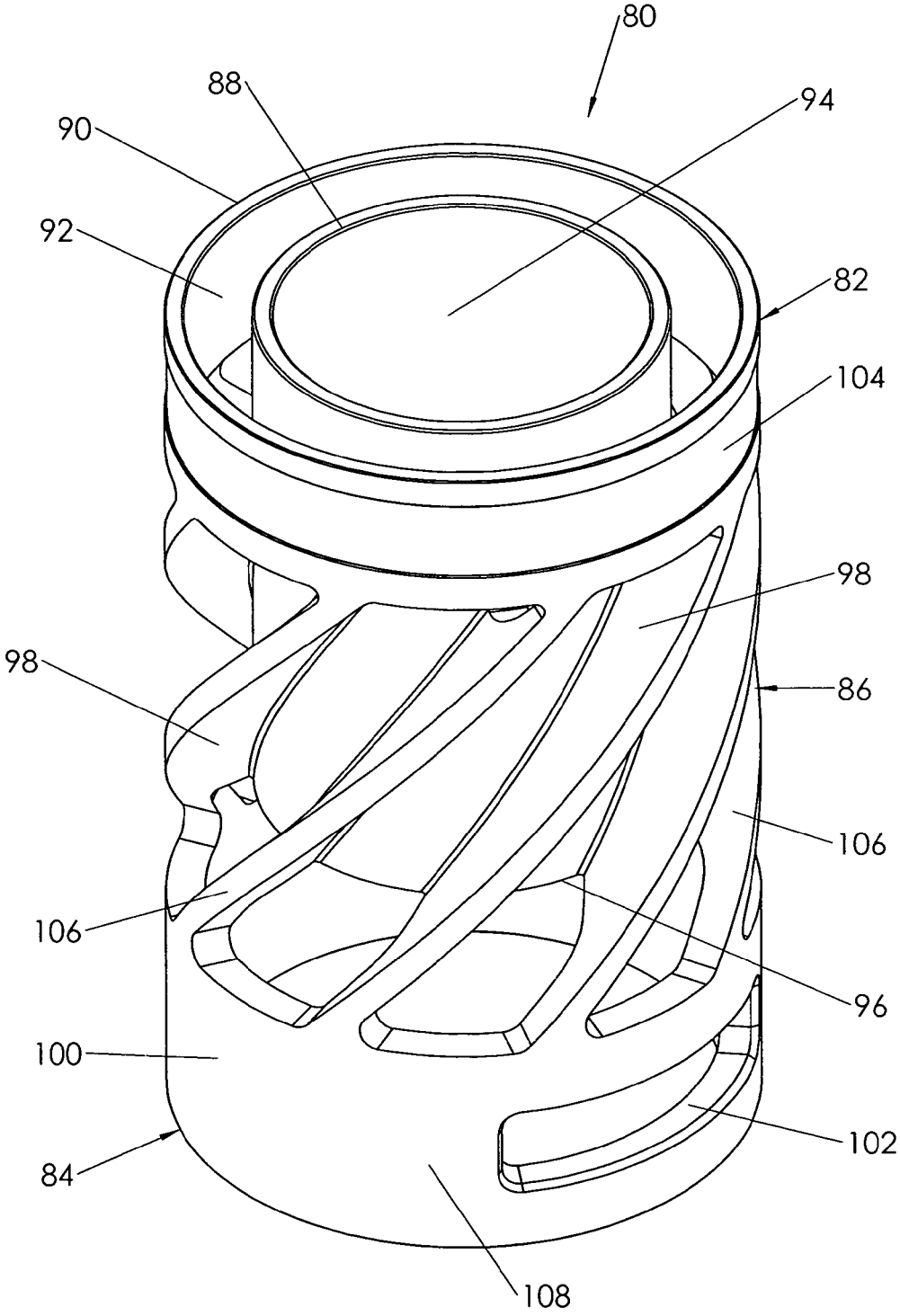
FIG. 4 is a perspective view of a rotor of the apparatus of FIG. 2.

With reference to FIG. 4, the rotor 80 comprises a substantially cylindrical body having inlet and outlet sections, 82 and 84, respectively and a turbine section 86 therebetween. The rotor inlet section 82 of the rotor comprise an outer sleeve 90 and a bypass cylinder 88 defining an annular rotor passage 92 therebetween. The outer sleeve 90 includes an outer surface 104. The bypass cylinder 88 defines a bypass passage 94 therethrough and as a distal end 96 extending substantially into the turbine section 86 as illustrated in FIG. 4. The turbine section 86 comprises a plurality of vanes 98 extending angularly from the inlet to outlet sections 82 and 84. Proximate to the inlet section 82, the vanes 98 extend between the outer sleeve 90 and the bypass cylinder 88 so as to provide support for the bypass cylinder. The vanes 98 include an exterior surface 106 corresponding to the outer surface 104 of the outer sleeve 90. The outlet section 84 comprises an outlet sleeve 100 having a rotor port 102 in a sidewall thereof. The outlet sleeve 100 has an outer surface 108. The outer surfaces of the outer sleeve 90, the vanes 98 and the outlet sleeve 100 act as a bearing surface to permit the rotor 80 to freely rotate within the central bore 40 of the tubular body 30. The rotor 80 may be formed of any suitable material such as steel and may be surface hardened for resistance to impact and surface abrasion. The rotor may be machined as a single component. Alternatively, the rotor may be formed of a plurality of components which are fastened, welded or otherwise secured to each other.

The apparatus 20 may be assembled by rotatably locating the rotor 80 and fixably locating the fluid separator 60 within central bore 40 of the tubular body. The rotor is located such that the rotor port 102 is alignable with the tubular body port 42 and the flow separator 60 is located adjacent to the inlet section of the rotor 80. The rotor passages 64 of the separator direct drilling fluid into the rotor passage 92 of the rotor while the bypass passage 62 of the flow separator 60 directs a bypass portion of the drilling fluid through the bypass passage 94 of the rotor. The rotor portion of the drilling fluid passed through the rotor passage 92 of the rotor will encounter the vanes 98 thereby causing the rotor to rotate. As the rotor 80 rotates within the tubular body 30, the rotor port 102 will be intermittently aligned with the tubular body port 42 so as to intermittently jet a portion of drilling fluid therethrough. Each ejection of drilling fluid through the rotor port 102 and tubular body port 42 causes a reduction of the pressure of the drilling fluid within the drill string and a corresponding low pressure wave through such drilling fluid. The intermittent ejection of the drilling fluid will create a resonant frequency to be established within the drilling fluid from the multiple low pressure pulses. The multiple pulses causes a vibration to be transmitted from the drilling fluid to the drill string 10 so as to vibrate the drill string 10 within the bore hole 8.

With reference to FIG. 2, the central bore 40 of the tubular body 30 may have an inlet section 110 sized to receive the flow separator 60 snugly therein. The inlet section 110 may end at a first shoulder 112 for retaining the flow separator within the inlet section of the central bore 40. The flow separator may also be retained against the first shoulder 112 by a snap ring 114 or other suitable means. The flow separator 60 may also be sealed within the inlet section 110 by an o-ring 116 or other suitable means. The central bore 40 also includes a rotor portion 120 sized to rotatably receive the rotor 80 therein. The rotor portion 120 ends in a second shoulder 122 for retaining the rotor 80 within the rotor section 120. The flow separator 60 serves to retain the rotor 80 against the second shoulder. The apparatus may also include a wear ring 124 sized to abut against the second shoulder 122 and provide an enlarged surface to retain the rotor 80 within the rotor section 120. The wear ring 124 may be sealed within the rotor section by an o-ring 126 or the like. As shown in FIG. 2, the wear ring 124 functions as a thrust bearing against the rotor 80. The wear ring 124 is easily replaceable and expendable. Grooves in the bearing surface help prevent debris from collecting on the bearing surface, thus improving the wear rate. Multiple material types can be used depending on the application. Alternative bearing types such as rolling element bearings are also applicable. The rotor 80 and the flow separator 60 may be inserted into the tubular body 30 through the inlet end 36 of the apparatus and are sized to fit through the internal threading 46.

As described above, the flow separator 60 is a flow distributing device which directs a prescribed amount of drilling fluid flow through to the vanes 98 of the rotor 80. As illustrated in FIG. 2, drilling fluid is pumped downwards within the drill string 10 and therefore through the apparatus 20 as indicated generally at 142. By correctly sizing or adjusting the rotor passage 64 the flow separator will direct sufficient flow through the rotor 80 to allow the rotor to spin at the desired rotational speed. The remaining flow is directed through the bypass passage 62 and subsequently through a bypass passage 94 of the rotor 80. The diameter of the bypass passage 62 can be adjusted to allow for variations in fluid flow rate and fluid properties. The bypass passage 62 of the flow separator 60 may also be included in a threaded orifice plug (with or without a centre bore) in the centre of the flow separator 60 to permit the bypass passage 62 size can be adjusted without replacing the flow separator.

Figure 5:
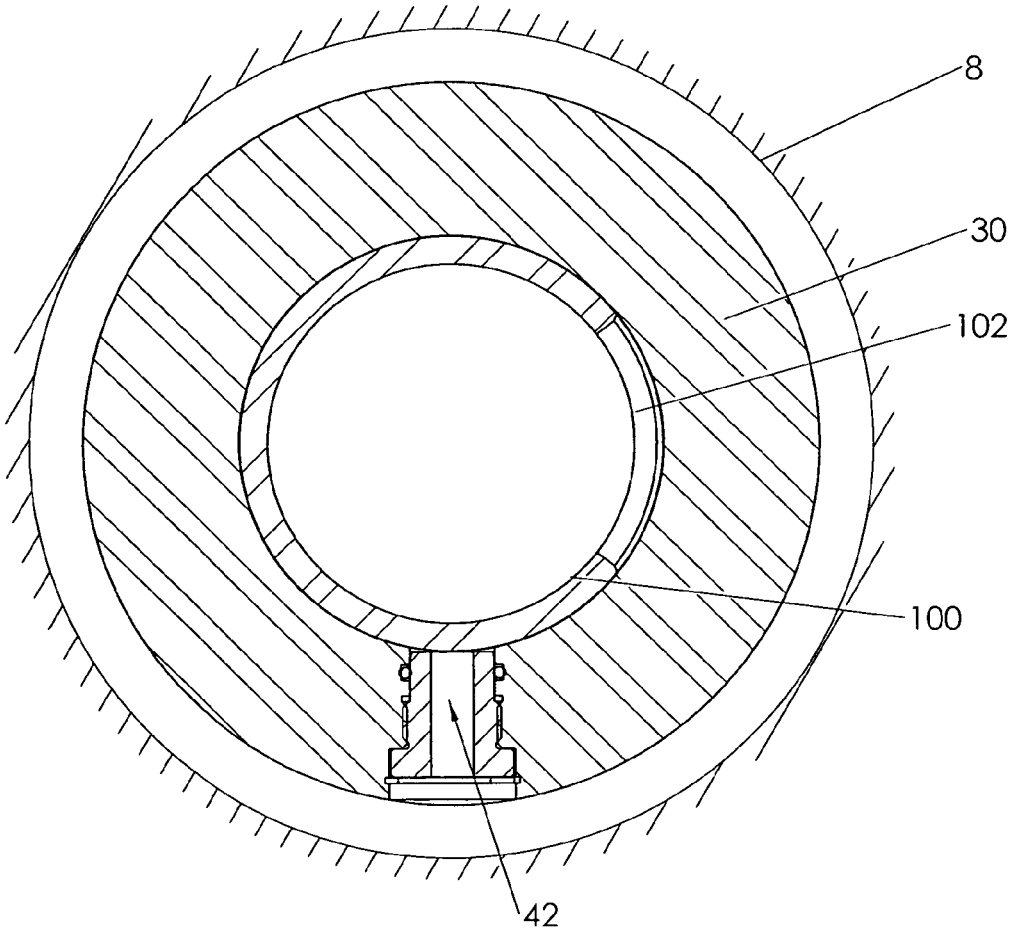
FIG. 5 is a cross sectional view of the apparatus of FIG. 2 taken along the line 5-5 with the rotor at a first position.
Figure 6:
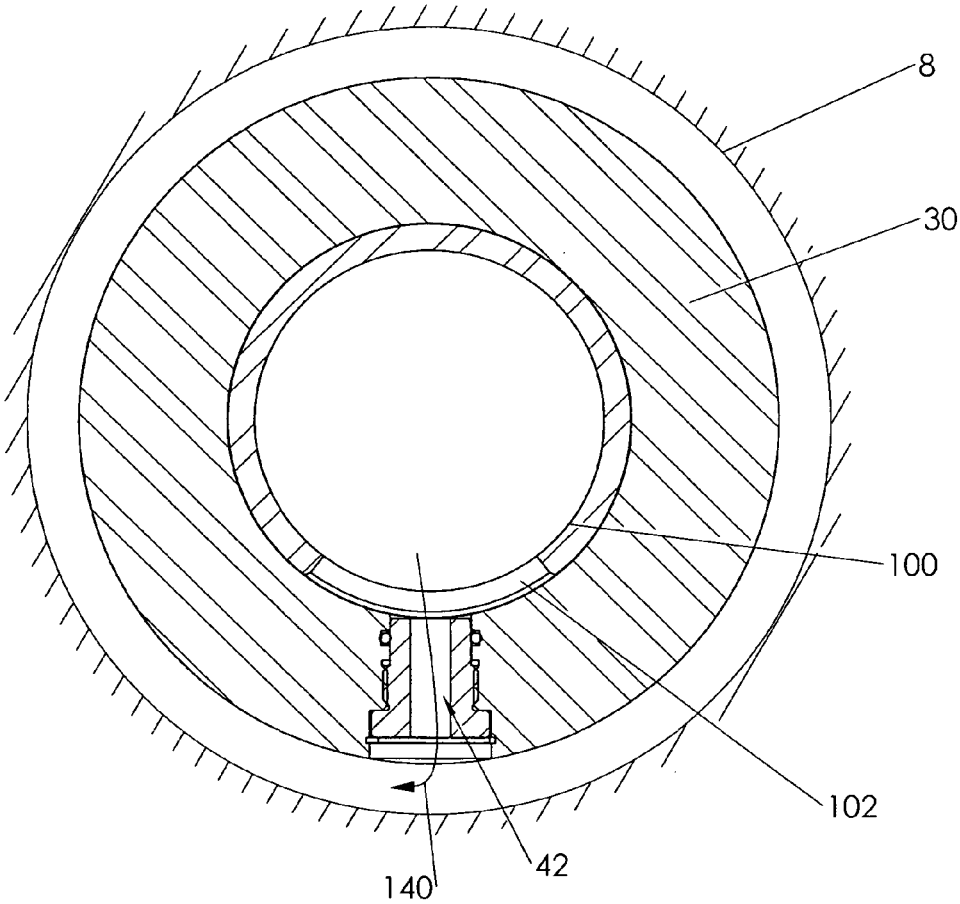
FIG. 6 is a cross sectional view of the apparatus of FIG. 2 taken along the line 5-5 with the rotor at a second position.

The rotor 80 is designed to spin at a set rotational speed. To achieve this, the rotor is designed to be free spinning and rotate at its runaway speed. As the flow enters the rotor 80 through the rotor passage 92 and is then directed onto the vanes 98. The angle of the vanes 98 determine the runaway speed of the turbine for a given flow rate. Closing the bypass passage 94 entirely (i.e. sending all available flow through the rotor passage 92) will allow the rotor to maintain its intended rotational speed should the flow rate be reduced by 50%. As the rotor 80 rotates, drilling fluid is jetted through the rotor port 102 and the tubular body port 42 once per revolution when the rotor port and tubular body port are aligned. As illustrated in FIG. 5, the rotor 80 is illustrated in a first or closed position within the tubular body 30. As illustrated, the rotor pot 102 and the tubular body port 42 are not aligned and therefore no drilling fluid is passed therethrough. Turning now to FIG. 6, the rotor is illustrated in a second or open position within the tubular body 30. In the open position, the rotor port 102 and the tubular body port 42 are aligned and therefore the drilling fluid is passed therethrough as indicated generally at 140. The second position is generally referred to herein as a jetting event.

The width of the rotor port 102 determines the duration of the jetting event and can be varied depending on the demands of the application. The diameter of the tubular body port 42 may also be sized to vary the volume of drilling fluid ejected during a jetting event and thereby to vary the impulse delivered to the apparatus 20 by that jetting event. Although one tubular body port 42 is illustrated, it will be appreciated that a plurality of tubular body ports 42 may be utilized. Such plurality of tubular body ports 42 may be located to jet drilling fluid at a common or a different time as desired by the user. Furthermore, the plurality of tubular body ports 42 may be located at different lengthwise locations along the tubular body 30. The rotor port 102 may therefore have a variable width from the top to the bottom such that when a specific tubular body port 42 is selected, the apparatus 20 will have a jetting event length corresponding to the width of the rotor port 102 at that location. All other tubular body ports 42 will therefore be plugged. In other embodiments, a plurality of rotor ports 102 may be utilized each having a unique length and a corresponding tubular body port 42 to produce a jetting event of a desired duration.

Figure 7:
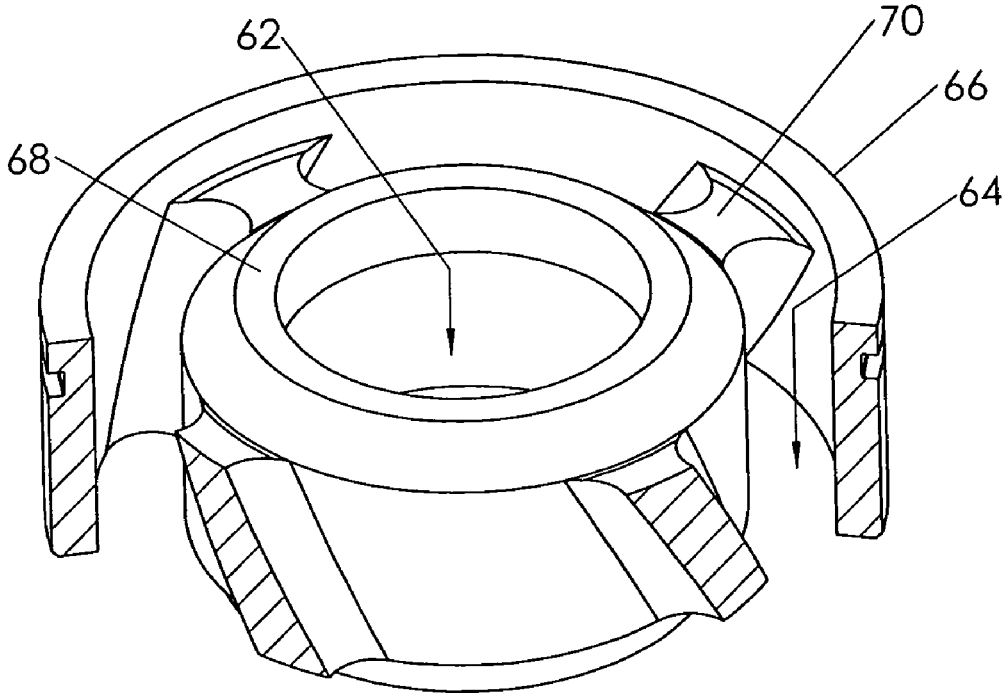
FIG. 7 is a perspective view of the flow separator of the apparatus of FIG. 2 according to a further embodiment.

With reference to FIG. 7, inlet to the bypass passage 62 of the flow separator 60 may also be shaped to allow a blocking body (not shown) to land therein so as to partially block the bypass passage 62 thereby altering the flow distribution and the rotational speed of the turbine. The blocking body may comprise a spherical body although it will be appreciated that other shapes may be useful as well. This allows the torque capacity/speed of the apparatus to be adjusted during operation, without returning the apparatus to surface. In a further embodiment, the support arms 70 of the flow separator may be shaped to act as turbine stator blades, thereby increasing the torque capability of the rotor 80. This additional torque may be required for heavy or viscous mud conditions.

With reference to FIG. 7, inlet to the bypass passage 62 of the flow separator 60 may also be shaped to allow a blocking body (not shown) to land therein so as to partially block the bypass passage 62 thereby altering the flow distribution and the rotational speed of the turbine. The blocking body may comprise a spherical body although it will be appreciated that other shapes may be useful as well. This allows the torque capacity/speed of the apparatus to be adjusted during operation, without returning the apparatus to surface. In a further embodiment, the support arms 70 of the flow separator may be shaped to act as turbine stator blades, thereby increasing the torque capability of the rotor 80. This additional torque may be required for heavy or viscous mud conditions.

The apparatus 20 creates pressure fluctuations that induce vibration in a drill string 10 and create a time varying WOB (weight on bit) with a cycling frequency of approximately 15-20 Hz (the natural frequency of the drill string). This vibration or hammering effect reduces wall friction and improves the transfer of force on to the drill bit. The rotor port 102 and the tubular body port 42 function as a valve that is cyclically opened and closed by the rotation of the rotor. It will be appreciated that such a valve function may be provided in another means for venting the drilling fluid from the drill string such as through the use of common valves as known in the art. It will also be appreciated that the tubular body port 42 may be selectably opened by a wide variety of methods. By way of non-limiting example, the tubular body port 42 may be cyclically opened by a solenoid valve or other suitable means or through the use of a motor for rotating the rotor 80. It will be appreciated that in such embodiments, the flow separator 60 and rotor 80 will not be necessary.

While specific embodiments of the invention have been described and illustrated, such embodiments should be considered illustrative of the invention only and not as limiting the invention as construed in accordance with the accompanying claims.

What is claimed is:

1. A method of vibrating a downhole drill string, the method comprising:

pumping a drilling fluid down the drill string;

cyclically venting said drilling fluid through a valve in a side wall of said drilling string so as to cyclically reduce the pressure of said drilling fluid in said drill string; and rotating a rotor within a tubular body located in-line within said drill string wherein said venting comprises intermittently passing said drilling fluid through a rotor port in said rotor and a corresponding tubular body port in said tubular body.

2. The method of claim 1 further comprising rotating said rotor with said drilling fluid.

3. The method of claim 2 further comprising separating said drilling fluid into a central bypass portion and an annular rotor portion, passing said bypass portion past said rotor and rotating said rotor with said rotor portion.

4. The method of claim 3 wherein said bypass portion and said rotor portion are combined after said rotor portion rotates said rotor wherein said rotor port and said tubular port pass said combined rotor portion and said bypass portion therethrough.

5. An apparatus for vibrating a downhole drill string, the drill string being operable to have a drilling fluid pumped therethrough, the apparatus comprising:

a tubular body securable to said drill string and having a central bore therethrough;

a valve in said tubular body for venting said drilling fluid out of said drill string; and a valve actuator for cyclically opening and closing said valve;

wherein said valve comprises a radial tubular body port in said tubular body and a rotor located within said central bore having a radial rotor port wherein said rotor port is selectable alienable with said tubular body port as said rotor rotates within said central bore.

6. The apparatus of claim 5 wherein said valve actuator comprises at least one vane on said rotor for rotating said rotor as said drilling fluid flows therepast.

7. The apparatus of claim 6 wherein said rotor includes a central bypass bore therethrough and a plurality of vanes radially arranged around said central bypass bore.

8. The apparatus of claim 7 further comprising a separator for separating the drilling fluid into a bypass portion and a rotor portion secured within said central bore, said rotor portion being directed onto said plurality of vanes so as to rotate said rotor, said bypass portion being directed though said bypass bore of said rotor.

9. The apparatus of claim 8 wherein said separator includes a central bypass port and an annular rotor passage therearound.

10. The apparatus of claim 9 wherein said separator is located adjacent to said rotor such that said central bypass port of said separator directs said bypass portion of said drilling fluid though said bypass bore of said rotor and wherein said rotor passage of said separator directs said rotor portion of said drilling fluid onto said plurality of vanes of said rotor.

11. The apparatus of claim 10 wherein said rotor passage of said separator includes stator vanes for directing said rotor portion of said drilling fluid onto said plurality of vanes.

12. The apparatus of claim 9 wherein said bypass port of said separator includes an inlet shaped to receive a blocking body so as to selectably direct more drilling fluid through said rotor passage.

13. The apparatus of claim 12 wherein said inlet has a substantially spherical shape so as to receive a spherical blocking body.

14. The apparatus of claim 5 further comprising a plurality of rotor ports selectably alignable with a plurality of tubular body ports.

15. The apparatus of claim 14 wherein each of said plurality of rotor ports is selectably alignable with a unique tubular body port.

16. The apparatus of claim 5 wherein said tubular body is connectable inline within a drill string.

17. The apparatus of claim 16 wherein said tubular body includes threaded end connectors for linear connection within a drill string.

* * * * *